US005329683A

United States Patent [19]

Butkus et al.

[11] Patent Number: 5,329,683

[45] Date of Patent: Jul. 19, 1994

[54] FASTENER SETTING APPARATUS HAVING REINFORCING TAPE FEEDER

[75] Inventors: John J. Butkus, Woodbury; Paul R. Bird, Naugatuck, both of Conn.

[73] Assignee: Scovill Fasteners Inc., Clarkesville, Ga.

[21] Appl. No.: 83,294

[22] Filed: Jun. 29, 1993

[51] Int. Cl.[5] ..... B23Q 3/00; B27F 7/19

[52] U.S. Cl. ..... 29/34 R; 227/16; 227/21

[58] Field of Search ..... 29/34 R, 564.8, 34.8; 227/16, 17, 18, 21; 226/129; 83/40, 39

[56] References Cited

U.S. PATENT DOCUMENTS

| | | | |
|---|---|---|---|
| 2,992,431 | 7/1961 | Jensen | 227/21 |
| 3,084,344 | 4/1963 | Schmidt | 227/21 |
| 3,226,281 | 12/1965 | Carpinella | 227/17 |
| 4,434,928 | 3/1984 | Seki | 227/16 |
| 4,790,469 | 12/1988 | Toyota | 227/18 X |

*Primary Examiner*—William Briggs

*Attorney, Agent, or Firm*—Dallett Hoopes

[57] ABSTRACT

A setting apparatus directs a reinforcing tape in a perpendicular direction to the path of movement of the fabric. It comprises a machine frame, a support plate, a setting punch and die, a reinforcing tape supply under the plate and tape feeding belt for feeding the tape which is automatically activated by the punch.

20 Claims, 3 Drawing Sheets

FASTENER SETTING APPARATUS HAVING REINFORCING TAPE FEEDER

BACKGROUND OF THE INVENTION

1. Field of the Invention

This invention relates to an apparatus for setting snap fasteners and the like onto fabric and includes feed means for feeding a reinforcing tape to be sandwiched between the fabric and a fastener part to reinforce the fabric. More specifically, this invention relates to such an apparatus in which the tape is fed perpendicular to the movement of the fabric for the purpose of using a short length of tape from feed roll to attachment and making the feed unit more accessible for repair and reloading.

2. Description of Related Art including Information Disclosed under §§1.97 to 1.99

There are patents in the prior art which deal with fastener setting apparatus having means to apply reinforcing tape to fortify a fragile fabric so that the fabric does not easily tear at the point of attachment. An example is disclosed in the U.S. Pat. No. 2,992,431 which issued to P. B. Jensen Jul. 18, 1961. While the reinforcing path applied is primarily intended to be ornamental, it does, as explained, also serve the function of reinforcing the fabric. The tape in Jensen moves in the same direction as the garment piece itself and, as a result, there is a considerable length of reinforcing material from roll to attachment.

Another example of a setting apparatus shown using a reinforcing tape feature is U.S. Pat. No. 3,084,344 which issued Apr. 9, 1963 to E. A. Schmidt. It discloses a waistband applier with a reinforcing tape dispensing means. The supply of reinforcing material is delivered parallel to the path of the main fabric and the feed and severing operating means are cut off by rods driven by the main power motor.

SUMMARY OF THE INVENTION

The present invention has for an object a setting apparatus including a reinforcing tape feature which directs the tape in a perpendicular direction to the path of movement of the fabric and is characterized by the use of a minimum distance between the supply roll and attachment. The arrangement of the invention also provides for ready accessibility of the feeder for repair and refill.

The apparatus comprises a machine frame, a horizontal fabric support plate on the frame, a vertically aligned upper punch and lower die reciprocable in the frame feeding means in the frame for feeding fastener parts to receive on the respective punch and die, a reinforcing tape supply under the plate and tape feeding means for feeding the end of the tape in a direction perpendicular to the movement of fabric to a working position which overlies the lower die. The invention also includes means for severing the reinforcing tape which is automatically activated as the punch rises after the setting operation.

BRIEF DESCRIPTION OF THE DRAWINGS

Further features and objects of the invention will be apparent to those skilled in the art from a study of the following specification and the accompanying drawings, all of which disclose non-limiting embodiments of the invention. In the drawings.

DESCRIPTION OF THE PREFERRED EMBODIMENTS

Figure 1:
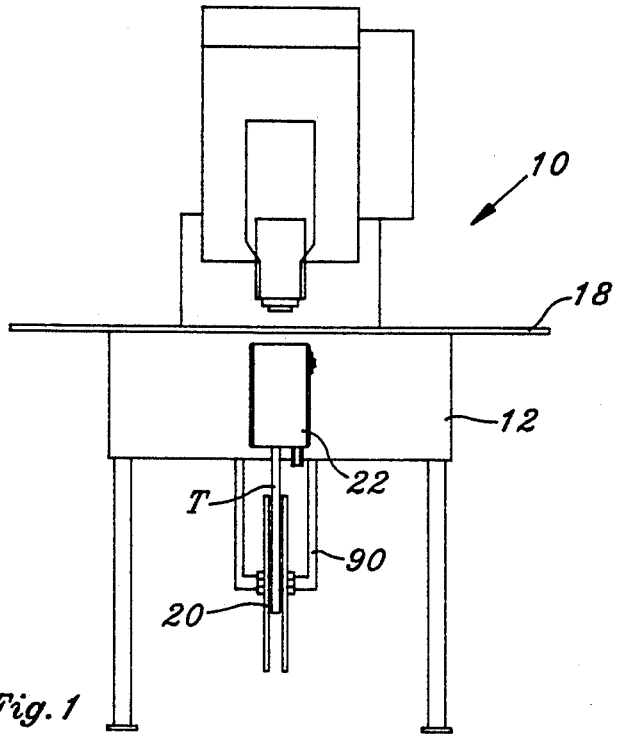
FIG. 1 is a simplified front view as seen by the operator of a fastener attaching apparatus embodying the invention.

An apparatus embodying the invention is generally designated 10 in FIG. 1. It comprises a frame 12 having a reciprocable punch 14 on the lower end of which is an upper part receiver (not shown). As is conventional, a pusher (not shown) moves the upper fastener parts to the receiver on the bottom of the punch. The frame also mounts a lower die 16 having a receiver (not shown). A second pusher (not shown) supplies lower fastener parts to the lower receiver. Parts supplies which supply the pushers and means for driving the various parts are not shown but are well disclosed in the art.

Just above the lower die the frame mounts a horizontally disposed fabric support plate 18. The rear edge **18*a*** thereof may be a guide edge for fabric.

Figure 4:
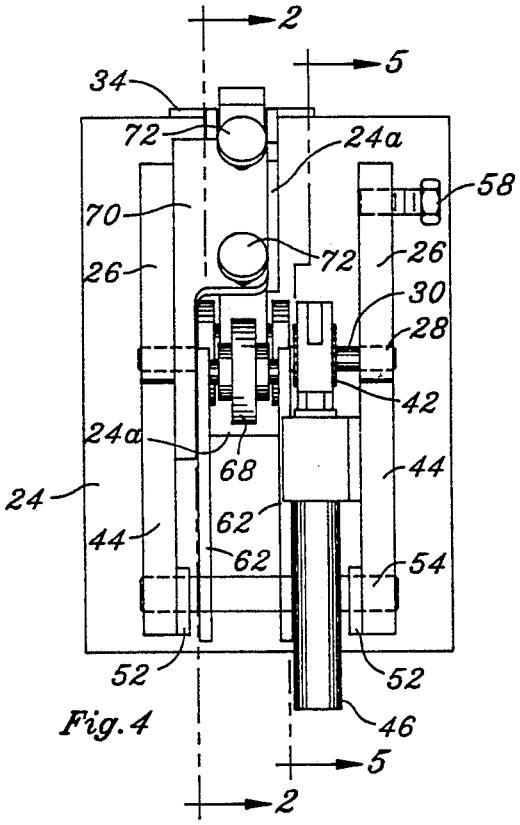
FIG. 4 is an enlarged (with respect to FIG. 1) front view of the feed mechanism with cover removed.

Under the front of the plate 18 is the reinforcing tape supply 20 and feeding means 22. It comprises a base plate 24 secured with intermediate spacer plates (FIG. 2) to the frame The base plate mounts a pair of vertically disposed spaced parallel side plates 26 (FIG. 4). The side plates are apertured in alignment at 28 and journal a lower roller drive shaft 30.

Figure 2:
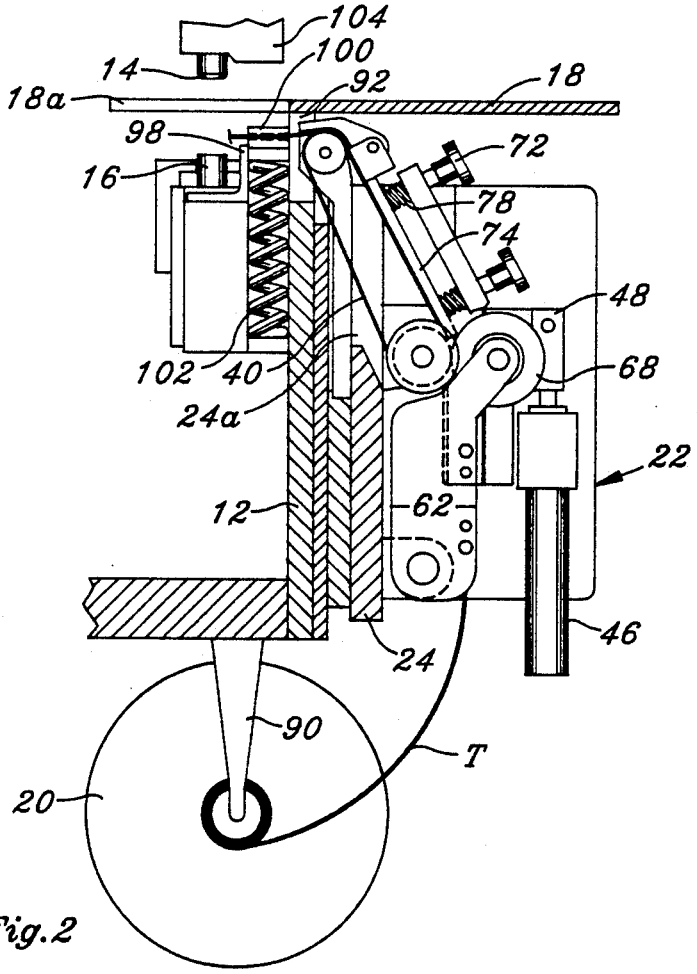
FIG. 2 is a sectional view of the reinforcing tape feeding apparatus taken on the line 2—2 of FIG. 4 and including the lower die, the fabric support plate and the punch shown in fragment.

Intermediate its ends the shaft 30 fixedly carries a lower roller 32 (FIG. 2). The base plate 24 is notched as at **24*a* in alignment with the lower roller 30 and the rear face of the base plate carries a pair of arms 34 which are spaced on opposite sides of the notch. The upper ends of the arms are apertured in alignment and journal shaft 36 carrying the upper roller 38. A belt 40 extends through the notch 24*a* and is trained over the upper and lower rollers 32, 38** as shown.

The lower shaft 30 mounts on its right side (FIG. 4) a pinion 42. The pinion 42 incorporates, or has thereadjacent, a commercially available one-way clutch, not shown in detail, for reasons which will appear.

Figure 5:
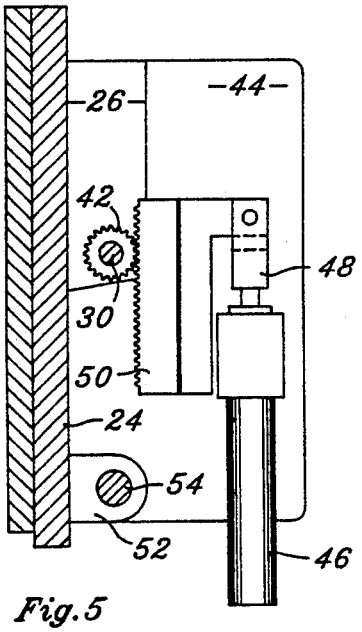
FIG. 5 is a sectional view taken on the line 5—5 of FIG. 4.

Aligned respectively with and partly overlying the side plates 26 are the pivoted flanking plates 44. The rightward plate 44 (FIG. 4) mounts a pneumatic cylinder 46. The connecting rod (FIG. 5) of the cylinder 46 has a yoke 48 on its upper end which mounts vertical rack 50 meshing with the pinion 42 when the flanking plates are in the closed position. Thus, as the cylinder 46 drives the yoke 48 up and down in operation, it oscilates the pinion 42. Because of the one-way clutch associated with the pinion, as explained, the oscillation causes shaft 30 to intermittently step forward. This intermittenly moves the belt 46 to drive forward the reinforcing tape T as will be decribed.

The flanking plates 44 are pivoted to the base plate 24 in the following manner. At the lower end of the base plate are secured a pair of spaced aligned apertured knuckles 52. Through these a pintle 54 freely passes. The flanking plates 44 are secured respectively to the opposite ends of the pintle as shown so that the two plates 44 pivot together. The plates 44 may be held in closed position snug against the side plates 26 by a bifurcated latch 56 which straddles a closure bolt 58 which can be screwed tight on the latch.

A pressure assembly 60 (FIG. 3) comprises a pair of parallel arms 62 which are apertured at their lower ends and fixedly secured to the pintle inside the knuckles 52. At their distal ends the arms 62 are apertured in alignment and mount a bearing roller shaft 66. A bearing roller 68 freely rotates on the shaft 66 and presses against the belt 46 to squeeze the tape T inbetween (FIG. 2).

Figure 3:
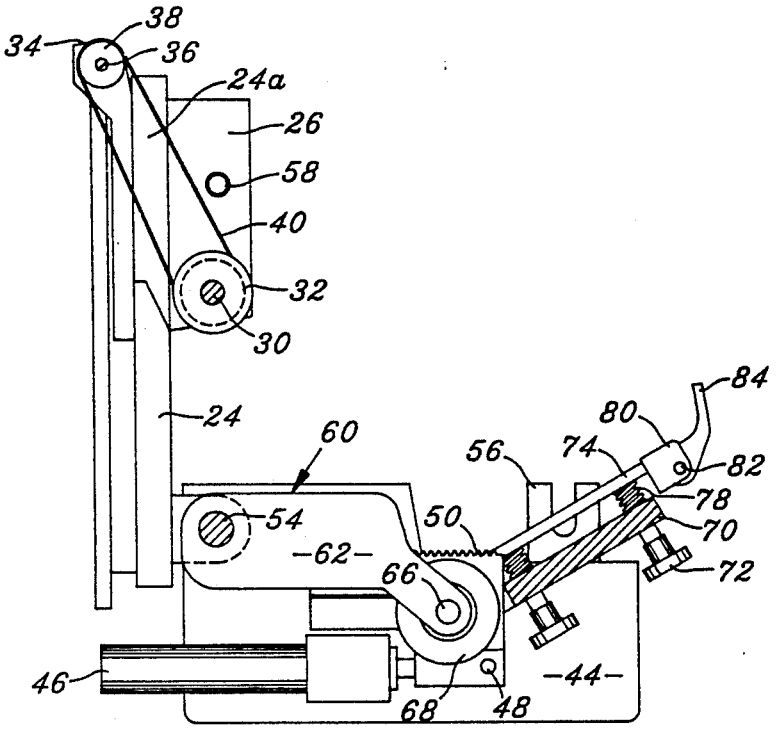
FIG. 3 is a front view of the reinforcing tape feeding apparatus pivotted open.

Fixedly mounted on the leftward flanking plate 44 is a pressure arm 70. The arm is apertured and tapped and threadedly receives a pair of thumb screws 72. At their opposite ends the thumb screws 72 carry the pressure plate 74 and compression springs 78 space the plate 76 away from the arm 70. At the top of the arm is formed a yoke 80 (FIG. 3). The yoke mounts a transverse pin 82 which carries a pressure finger 84 biased toward the roller 44 by means not shown.

Under the feeder is a supply yoke 90 secured to the frame 12. The yoke mounts a supply reel carrying tape T.

As shown in FIG. 2, the frame 12 is apertured as at 92 to give access to the roller 38 and belt 46 and passage to the tape T. Adjacent the aperture 92 is the mounting for the lower die 16 and its receiver. Surrounding the lower die is an upwardly biased fixture 96 with a stationary upstanding cutting arm 98. A shear channel piece 100 is disposed adjacent the opening 92 and supported on the heavy spring 102. The leftward end (FIG. 2) of the channel piece abuts the upstanding cutter arm 98.

The lower end of the punch is provided with a cutting finger 104 vertically aligned with the channel piece 100. The finger moves up and down with the punch.

In the loading of the reinforcing tape, the flanking plates 44 are opened, and the leading end of the tape T is fed upward over the lower roller 32 and along the upper run of belt 40, through the access opening 92 and the channel piece 100. The flanking plates 44 of the feeder are then closed and secured by bolt 58.

In the closing of the flanking plates 44, the arms 62 fixed to pintle 54 assume the position of FIG. 2 with the roller 68 squeezing against the roller 32, the tape T inbetween. Also, the arm 70 is brought to the position shown in FIG. 2 so that the plate 74 presses against the upper surface of the tape T and the finger 84 covers the tape and aims it toward the channel piece 100.

Sequence of operations is that the lower pusher delivers a lower fastener part on the lower receiver which superposes the die 16. The upper receiver (not shown) is provided with an upper fastener part, and the upper punch 14 is ready to drive down. The end of the tape T overlies the lower die 16 and the fabric F is in position above the opening **18*a* in the plate 18. The upper punch 14 drives down and presses the upper fastener part against the lower fastener part with both the fabric F and the tape T inbetween. The two parts clamp together in a manner well known in the art. Simultaneously, the finger 104 depresses the channel piece 100** rubbing against the end of the channel piece shearing off the tape.

With the fastener set and the tape thus cut, the fabric is readily moved to be moved to the next attachment site.

The raising of the punch signals the cylinder 52 which strokes upward driving the pinion and shaft 30, to rotate the roller 32 moving the belt 40 to extend the new tab of tape T out of the channel piece 100 and over the lower die ready for the next attachment. The cylinder then retracts.

Figure 6:
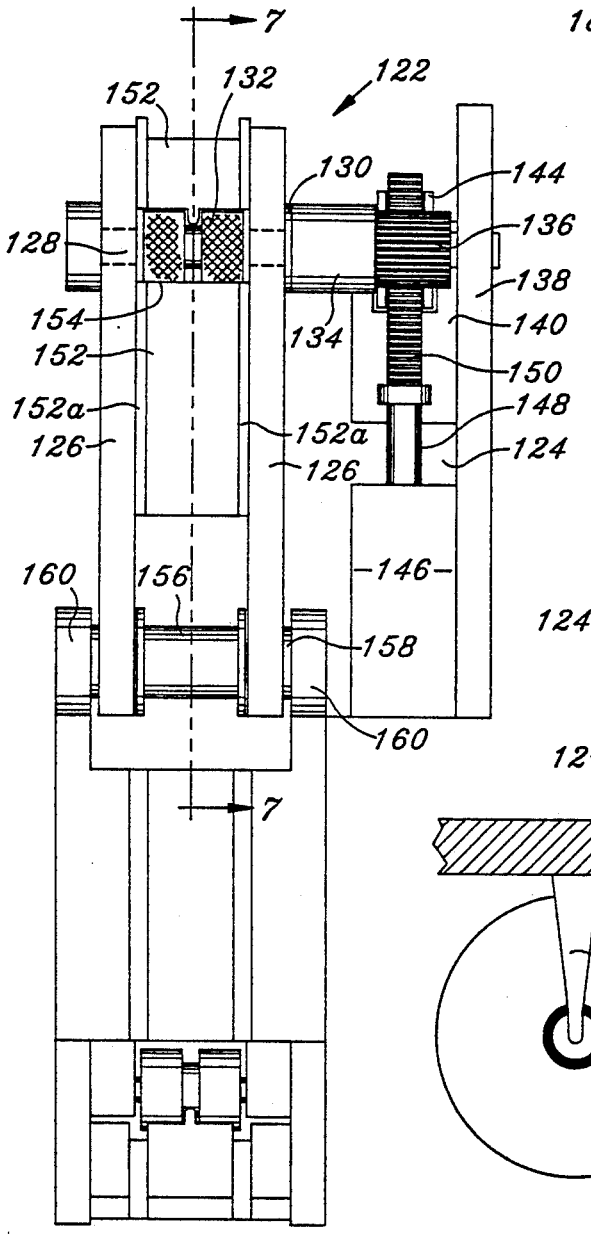
FIG. 6 is a front elevational view of a modified form of the invention with the pressure arm open and the guard removed.
Figure 7:
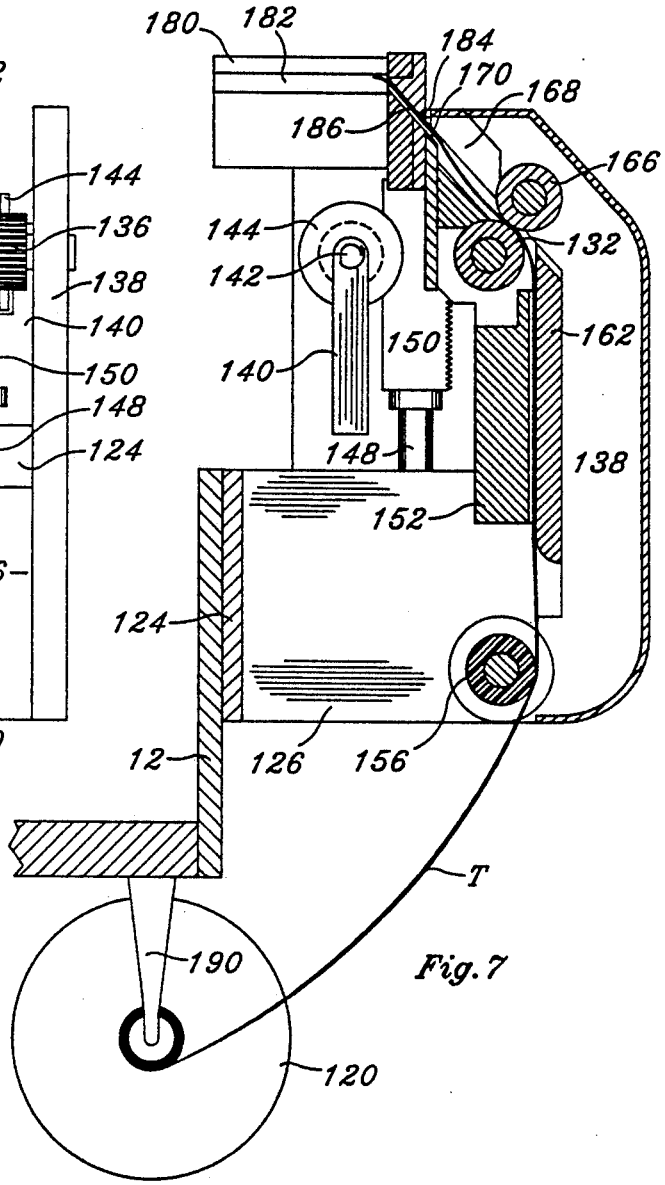
FIG. 7 is a sectional view taken on the line 7—7 of FIG. 6 but showing the pressure arm in the closed position and the guard in place.
Figure 8:
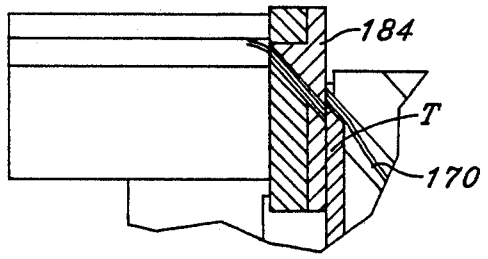
FIG. 8 is an enlarged view of the tape cutting operation showing the severing of the tape as the bottom receiver lowers during the setting operation.

A modified form of the invention is shown in FIGS. 6 through 8. The feed mechanism is shown front view in FIG. 6 and does not include adjacent structure on the attaching machine for reasons of simplicity. It will be understood that the FIG. 6 version will be mounted on the machine much in the way the structure shown in FIG. 4 is mounted.

The modified form of the invention includes a reinforcing tape supply 120 and feeding means 122. The feeding means comprises a base plate 124 secured to the frame 12. The base plate mounts a pair of vertically disposed side plates 126. The side plates 126 are apertured in alignment at 128 and journal a roller drive shaft 130. The shaft 130 rides in bearings (not shown) and features the knurled drive rollers 132. The shaft is provided with a one-way clutch mechanism 134 and a pinion 136. The end of the roller shaft rotates in a bearing in the end plate 138 which is securely fastened to the base plate 124.

Also secured to the end plate 138 is the roller mounting bracket 140 which journals at its upper end on a shaft 142 the backup roller 144.

An air cylinder 146 is mounted on the end plate 138 and its connecting rod 148 carries an upstanding rack gear 150 which meshes with the pinion 136 and is pressed against the pinion by the fixed backup roller 144. As the cylinder 146 is actuated, the rack travels up and down and oscillates the pinion 136 and by reason of the one-way clutch 134 moves the roller 132 intermittently in the same rotary direction.

A guide plate 152 is mounted between the side plates 126 and forms a broad U-shaped track with spaced upward side rails **152*a* and having a cutout at 154 for the knurled drive rollers 132. An idler roller 156 may be of plastic and is mounted on a shaft which is journaled in the lower ends of the side plates 126**.

The outer ends of the shaft 158 which extend outward from the side plates 156 serve as a pintle for the knuckles 160 of a pressure arm 162. The arm includes a pair of recesses 164 which receive the side tracks **152*a* when the arm 162 is closed, that is, hinged up as in FIG. 7. An upper idler roller 166 is journaled adjacent the end of the arm 162 and a tape guide 168 is adapted to guide the tape adjacent the roller 166. A knife 170** is stationary and directed upward adjacent the upper end of the assembly.

The lower receiver of the fastener setting machine is shown in simplified fashion at 180 in FIG. 7. It is mounted surrounding a stationary anvil (not shown) and includes tracks 182 which receive the lower fastener parts which are fed and into successively by a feeding finger, also not shown. The receiver is formed with a knife 184 and opening 186 for the tape.

In operation, reinforcing tape T from the supply 120 which is a reel mounted on yoke 190 secured to the frame 12 is led around the idler 156 (FIG. 7) and up along the tape guide plate 152, guided by the rails 152*a* on either side. The tape engages the drive rollers 132 and extends upward.

The pressure arm 162 is then hinged upward and closed so that the idler roller 166 (FIG. 7) engages the upper surface of the tape T, pressing it against the drive roller 132. The tape extends out over the knife 170.

After the previous fastener has been set, the air cylinder 146 is activated by means not shown. This drives the rack upward ratcheting the one-way clutch 34. Subsequently, the air cylinder is activated in the opposite direction, pulling the rack 150 downward. This is the power stroke and causes the surface of the roller 132 to rotate counterclockwise (FIG. 7) to drive the tape upward for a desired distance.

The pressure arm 162 is held in the closed position by means not shown which may be in the form of a threaded wing bolt, and a guard or cover plate may be secured to the end plate 138 to overlie and protect the mechanism of the rack and pinion movement 136, 150.

In the FIG. 7 version the punch carrying the upper fastener part comes down during the setting operation and carries an abutment which engages the top of the lower receiver and forces it downward against the force of spring means not shown. This downward movement of the receiver 180 causes the knife 184 (FIG. 8) to shear downward against the stationary knife 170 and shear off the tape T at that point just prior to the setting of the fastener.

The punch proceeds downward so that the two fastener parts, upper and lower, engage with the fabric and reinforcing tape inbetween. The tape, having been severed between knives 1 84, 170, is then free to move with the fabric and the fabric is moved onto the next setting site. The raising of the punch signals the cylinder 146, which strokes upward and then downward so that the rack, through the pinion 136, drives the rollers to feed up a new tab of tape T out of the opening 186 in the receiver and over the lower die ready for the next attachment.

The simplicity of the forms of the invention disclosed will be prized by those skilled in the art. Advantages include the accessibility of the feed immediately in front of the operator and the miserly minimizing of tape use: the tape is cut off very close to the attachment site.

It should be understood that the invention is not limited to the embodiment shown but the invention is instead defined by the scope of the following claim language, expanded by an extension of the right to exclude as is appropriate under the doctrine of equivalents.

What is claimed is:

1. Apparatus for setting snap fasteners onto a panel of fabric comprising:

a. a machine frame, b. a horizontally disposed fabric support plate on the frame, the plate having a rear edge and accommodating lateral movement of the fabric in a direction parallel to the rear edge, c. an axially aligned upper punch and a lower die reciprocable in the frame and means for driving the punch down toward the die to meet the die approximately at the level of the plate and for raising the punch, d. feeding means in the frame for feeding fastener parts to the respective punch and die, e. a reinforcing tape supply under the plate and tape feeding means secured to the frame for feeding the end of the tape in a direction perpendicular to the rear edge to a working position in which the tape end overlies the lower die, the tape feeding means comprising a driven means mounted on the frame and having an axis parallel to the rear edge and pressure means mounted on the frame under the plate and pivotable about an axis also parallel to the rear edge, the pressure means adapted to swing about its pivot from a lower disengaged position to an upper engaged position whereat it cooperates with the driven means to move the tape, and f. severing means adjacent the die for severing the tape activated by the movement of the punch, whereby as the punch reciprocates once the tape is fed to the working position, the punch and die set a fastener on the fabric with the reinforcing tape disposed against the fabric between parts of the fastener and the severing means severs the tape.

2. An apparatus as claimed in claim 1 wherein the tape feeding means is triggered by the raising of the punch.

3. An apparatus as claimed in claim 2 wherein the severing means is secured to an element resiliently mounted on the lower die which is depressed as the punch comes down and severs the tape.

4. An apparatus as claimed in claim 1 wherein the driven means comprises a pair of spaced rollers, a belt trained over the rollers, and motor means operatively connected by connection means to one of the rollers to rotate it and drive the belt.

5. An apparatus as claimed in claim 4 wherein the motor means is an air cylinder.

6. An apparatus as claimed in claim 5 wherein the connection means comprises a rack mounted on the end of the air cylinder and a pinion is connected to the said roller, the rack meshing with the pinion.

7. An apparatus as claimed in claim 6 wherein the pinion is connected to the said roller through a one-way clutch.

8. An apparatus as claimed in claim 1 wherein the driven means comprises parallel side plates journaling between them a drive roller, and motor means operatively connected by connection means to the drive roller to rotate it.

9. An apparatus as claimed in claim 8 wherein the motor means is an air cylinder.

10. An apparatus as claimed in claim 9 wherein the connection means comprises a rack mounted on the end of the air cylinder and a pinion is connected to the said roller, the rack meshing with the pinion.

11. An apparatus as claimed in claim 10 wherein the pinion is connected to the said roller through a one-way clutch.

12. An apparatus as claimed in claim 1 wherein the pressure means comprises an idler wheel adapted to press toward the driven means with the tape inbetween.

13. An apparatus as claimed in claim 1 wherein the pressure means comprises a pressure plate and spring means for urging the pressure plate toward the belt with the tape inbetween.

14. Apparatus for setting snap fasteners onto a panel of fabric comprising:

a. a machine frame, b. a horizontally disposed fabric support plate on the frame, the plate having a guide edge along the rear thereof for the positioning of the fabric, c. an axially aligned upper punch and a lower die reciprocable in the frame and means for driving the punch down toward the die to meet the die approximately at the level of the plate and for raising the punch, d. feeding means in the frame for feeding fastener parts to the respective punch and die, the feeding means being triggered by the raising of the punch, e. a reinforcing tape supply under the plate and tape feeding means secured to the frame for feeding the end of the tape in a direction perpendicular to the guide edge to a working position in which the tape end overlies the lower die, the tape feeding means comprising a pair of spaced rollers, a belt trained over the rollers, a pressure plate, spring means for urging the pressure plate toward the belt with the tape inbetween, and motor means operatively connected by connection means to one of the rollers to rotate it and drive the belt, and f. severing means secured to an element resiliently mounted on the lower die which is depressed as the punch comes down and severs the tape whereby as the punch reciprocates once the tape is fed to the working position, the punch and die set a fastener on the fabric with the reinforcing tape disposed against the fabric between parts of the fastener and the severing means severs the tape.

15. An apparatus as claimed in claim 14 wherein the motor means is an air cylinder.

16. An apparatus as claimed in claim 15 wherein the connection means comprises a rack mounted on the end of the air cylinder and a pinion is connected to the said roller, the rack meshing with the pinion.

17. An apparatus as claimed in claim 16 wherein the pinion is connected to the said roller through a one-way clutch.

18. Apparatus for setting snap fasteners onto a panel of fabric comprising:

a. a machine frame, b. a horizontally disposed fabric support plate on the frame, the plate having a guide edge along the rear thereof for the positioning of the fabric, c. an axially aligned upper punch and a lower die reciprocable in the frame and means for driving the punch down toward the die to meet the die approximately at the level of the plate and for raising the punch, d. feeding means in the frame for feeding fastener parts to the respective punch and die, the feeding means being triggered by the raising of the punch, e. a reinforcing tape supply under the plate and tape feeding means secured to the frame for feeding the end of the tape in a direction perpendicular to the guide edge to a working position in which the tape end overlies the lower die, the tape feeding means comprising parallel side plates journaling between them a drive roller, a pressure arm hinged to the side plates and amounting an idler roller for urging the tape against the drive roller when the arm is in a closed position, and motor means operatively connected by connection means to the drive roller to rotate it, and f. severing means secured to an element resiliently mounted on the lower die which is depressed as the die comes down and severs the tape, whereby as the punch reciprocates once the tape is fed to the working position, the punch and die set a fastener on the fabric with the reinforcing tape disposed against the fabric between parts of the fastener and the severing means severs the tape.

19. An apparatus as claimed in claim 18 wherein the motor means is an air cylinder.

20. An apparatus as claimed in claim 19 wherein the connection means comprises a rack mounted on the end of the air cylinder and a pinion is connected to the said roller, the rack meshing with the pinion.

* * * * *